US008036826B2

(12) United States Patent
MacIntosh et al.

(10) Patent No.: US 8,036,826 B2
(45) **Date of Patent: *Oct. 11, 2011**

(54) SPORTS SENSOR

(75) Inventors: Colin MacIntosh, Bruce (AU); Tony Rice, Bruce (AU); Shaun Holthouse, Scoresby (AU); Igor Van de Griendt, Scoresby (AU)

(73) Assignee: MNT Innovations Pty Ltd, Scoresby (AU)

( * ) Notice: Subject to any disclaimer, the term of this patent is extended or adjusted under 35 U.S.C. 154(b) by 681 days.

This patent is subject to a terminal disclaimer.

(21) Appl. No.: 12/121,960

(22) Filed: May 16, 2008

(65) Prior Publication Data

US 2008/0284650 A1 Nov. 20, 2008

(30) Foreign Application Priority Data

May 18, 2007 (AU) ..... 2007902652

(51) Int. Cl.
*G01C 21/00* (2006.01)

(52) U.S. Cl. ..... 701/213; 701/25; 701/207

(58) Field of Classification Search ..... 701/25, 701/207, 213; 702/188, 182
See application file for complete search history.

(56) References Cited

U.S. PATENT DOCUMENTS

| | | | | |
|---|---|---|---|---|
| 4,984,986 | A | 1/1991 | Vohnout | |
| 5,099,689 | A | 3/1992 | McGinn | |
| 6,148,262 | A | 11/2000 | Fry | |
| 6,308,649 | B1 | 10/2001 | Gedeon et al. | |
| 7,272,499 | B2 * | 9/2007 | Grenfell et al. | 701/213 |
| 2008/0046179 | A1 * | 2/2008 | Mackintosh et al. | 701/213 |

FOREIGN PATENT DOCUMENTS

| | | |
|---|---|---|
| AU | 2003277952 | 5/2004 |
| AU | 2006222732 | 10/2006 |
| WO | WO-2004039462 | 5/2004 |

* cited by examiner

*Primary Examiner* — Gertrude Arthur Jeanglaude
(74) *Attorney, Agent, or Firm* — Connolly Bove Lodge & Hutz LLP

(57) ABSTRACT

A data logger for a monitoring sports which includes an accelerometer, a gyro sensor to sense angular displacement, a GPS unit to sense position and velocity, a magnetometer to sense direction of movement, a heart rate monitor, and a controller programmed to manipulate the data and provide a display of the heart rate, speed, and other sport parameters. The data can be stored or transmitted to a remote computer for use by the coach. The device is useful in football codes, athletics, swimming, snow sports and cycling.

10 Claims, 7 Drawing Sheets

SPORTS SENSOR

CROSS REFERENCE TO RELATED APPLICATIONS

This nonprovisional application claims priority under 35 U.S.C. §119(a) on Patent Application No(s). 2007902652 filed in Australia on May 18, 2007, the entire contents of which are hereby incorporated by reference.

This invention relates to an improved method and system for monitoring performance characteristics of athletes and in particular the particular movements which contribute to enhanced performance.

BACKGROUND TO THE INVENTION

Monitoring of athletes performance both in training and in competition is important in the development and implementation of new approaches aimed at improving sporting performance.

The ability to measure and record athlete physiological information and positional information associated with athlete movement in real-time is critical in the process of athlete training and coaching. Blood oxygen, respiration, heart rates, velocity, acceleration/force, changes in direction, and position and many other factors are required in elite athlete training and coaching. The position, movement and force information plays an important role in effective analysis of the athlete performance, especially for rowers. For example, the stroke frequency, force and synchronisation of athletes are critical for the performance of the rowers in a competition. Currently the stroke information can only be measured in either dedicated sports laboratories or using simulated devices. Reliable analysis of the stroke rate and stroke distance in rowing has been a challenge for a long time due to the availability of the real scenario data, in particular a high precision of position, velocity and acceleration data. Existing technologies used for this purpose include theoretical studies, video-footage procedure, indoor tank procedure, computer modelling and ergometer studies. Much of the equipment is either too heavy, expensive, obtrusive or less reliable. Therefore, smart real-time monitoring during training and competition to help elite athletes to improve their performance and avoid injuries is critical for both athletes and coaches. Any methodology that would improve the situation would not only bring benefits to the rower practice, but also to many other sports related application including both team sports and individual athlete.

U.S. Pat. Nos. 4,984,986 and 5,099,689 disclose measuring systems for off water rowing apparatus which measure the number of strokes or the force applied to the machine.

U.S. Pat. No. 6,308,649 discloses a monitoring system for sail boat racing which provides feedback to the crew of such parameters as wind speed and direction boat speed, sail boat comfort parameters, sail shape, line tensions, rudder angle etc.

Some development of monitoring systems has occurred in non water sports.

U.S. Pat. No. 6,148,262 discloses a bike mounted sports computer including a GPS receiver to provide a mapping facility.

WO2004/039462 discloses a sensor for rowing which combines a GPS sensor with a three dimensional accelerometer.

In athletics the ability to monitor movement, acceleration and rhythm is useful in especially in track and field events. In team games such as football the ability to track and log the movements of players or log particular events or features of play, is useful to coaches.

It is an object of this invention to provide a device for real time monitoring of athlete performance.

BRIEF DESCRIPTION OF THE INVENTION

To this end the present invention provides a data acquisition system for use in sporting events which incorporates a) At least one inertial sensor measuring angular acceleration in at least one dimension
b) at least one accelerometer to derive acceleration and velocity data in 3 dimensions
c) a microcontroller with a clock to measure the angular acceleration and accelerometer data
d) a power supply
e) an optional communication means for transmission of angular acceleration and accelerometer data from the microcontroller to a computer device
f) said computer device and/or said micro controller being programmed to use the angular acceleration and accelerometer data to provide accurate output of parameters such as velocity, acceleration, changes of direction and distance traveled.

This device will provide longitudinal data from the training and competition environment and provide both athlete physiological data and performance data related to the sport. The number of inertial sensors measuring angular acceleration will depend on the number of dimensions that information is required for and this will vary from sport to sport.

A GPS receiver transmitter may be included in the device to derive location and speed parameters. In addition one or more magnetometers may be included in the device to derive direction of movement which can be combined with data from the GPS and accelerometer components. In some cases the magnetometers can be substituted for the angular acceleration sensors (gyros).

In some circumstances the magnetometers are preferable to gyroscopes. For instance to construct an inertial navigation system, you require a gravity model to separate out acceleration due to gravity. This can be determined with the gyroscopes (the traditional approach), however the magnetometers may be combined with GPS for an inertial navigation system. Since the magnetometers provide a continuous 3d magnetic north vector, and the GPS gives latitude and longitude, it is possible to use the gyroscopes with GPS to constuct a gravity model (remembering that a north vector in has a relationship with horizontal, depending on the latitude which is determined by the GPS. Magnetometers are usually less expensive than gyros, and the mathematics for the algorithm is much simpler enabling on the fly processing.

Preferably physiological sensors are also attached to the athlete and integrated with the sensor system. Heart rate is the prime parameter to be measured and this may be sensed using electrical sensors or microphones. Respiratory rate is also important and may be measured by sensing the stretching of a chest band or using a microphone and signal recognition software. Another parameter is arterial oxygen saturation which may be measured non invasively by a sensor, placed on an earlobe or finger tip, using pulse oximetry employing an infra red absorption technique. Infra-red spectroscopy may be used for non invasive measurement of blood lactate concentrations.

Preferably velocity is derived from the global position sensor or other wireless triangulation system and the accelerometer data is sampled to obtain movement characteristics of the sport being monitored. Preferably the accelerometer data is integrated to derive velocity related movement characteristics and drift is checked every second using the output from the global position sensor.

Depending on the processing power of the microcontroller much of the data processing a display can be carried out on the sensor itself and an external computer may not be necessary. The device may also incorporate appropriate storage for the collected data. The data can be transmitted to other computers by wireless or cable transmission.

This system provides a platform device which can be used for a wide range of sports simply by providing appropriate software to derive from the accelerometer and GPS data, the desired sport parameters such as stride frequency, velocity, stride length, vertical acceleration, time off the ground for long jumping and events such as aerial skiing or snowboarding. The angular acceleration sensor or gyrosensor measures angular change in up to 3 dimensions (pitch, yaw and roll) and is used to sense movements like strokes and turns in swimming or strides and loft time in running, or kicks in team sports such as football, in a similar fashion to accelerometers. Additionally the magnetometer sensors indicate direction of the movement.

The system of this invention can be used in swimming to identify stroke type, turns, and with turns the number of laps and the stroke rate per lap as well as lap times. Careful analysis of each stroke can show the efficiency and power by comparing the acceleration and deceleration cycles and the effect of breathing cycles. In open water swimming the GPS can also be used to provide an indication of location, direction, and speed relative to the course.

The system of this invention can be used in cycling to identify location, speed, power and heart rate. By adding a magnetometer to the unit on the cyclist pedal cadence can be sensed. Alternatively pedal cadence can be sensed by a unit on the bike and transferred to the unit on the cyclist using a radio frequency pickup unit. Pedal cadence can also be determined from the signals picked up from the accelerometer and the angular acceleration sensor.

In skiing the unit can detect velocity, position, and heart rate but also the power imparted by each leg and the lateral acceleration and deceleration. In jumping the unit can detect loft time and speed.

In team sports such as the various codes of football the movement of the player can be tracked. In addition to movement and position the direction and force of a kick, the impact force of a tackle or the energy expended in routines such as rucking, can be determined from the accelerometer and the angular acceleration sensor.

DETAILED DESCRIPTION OF THE INVENTION

Particular embodiments of the invention will be described.

FIG. 1 the core circuit diagram for monitor mounted on an athlete;

Figure 4:
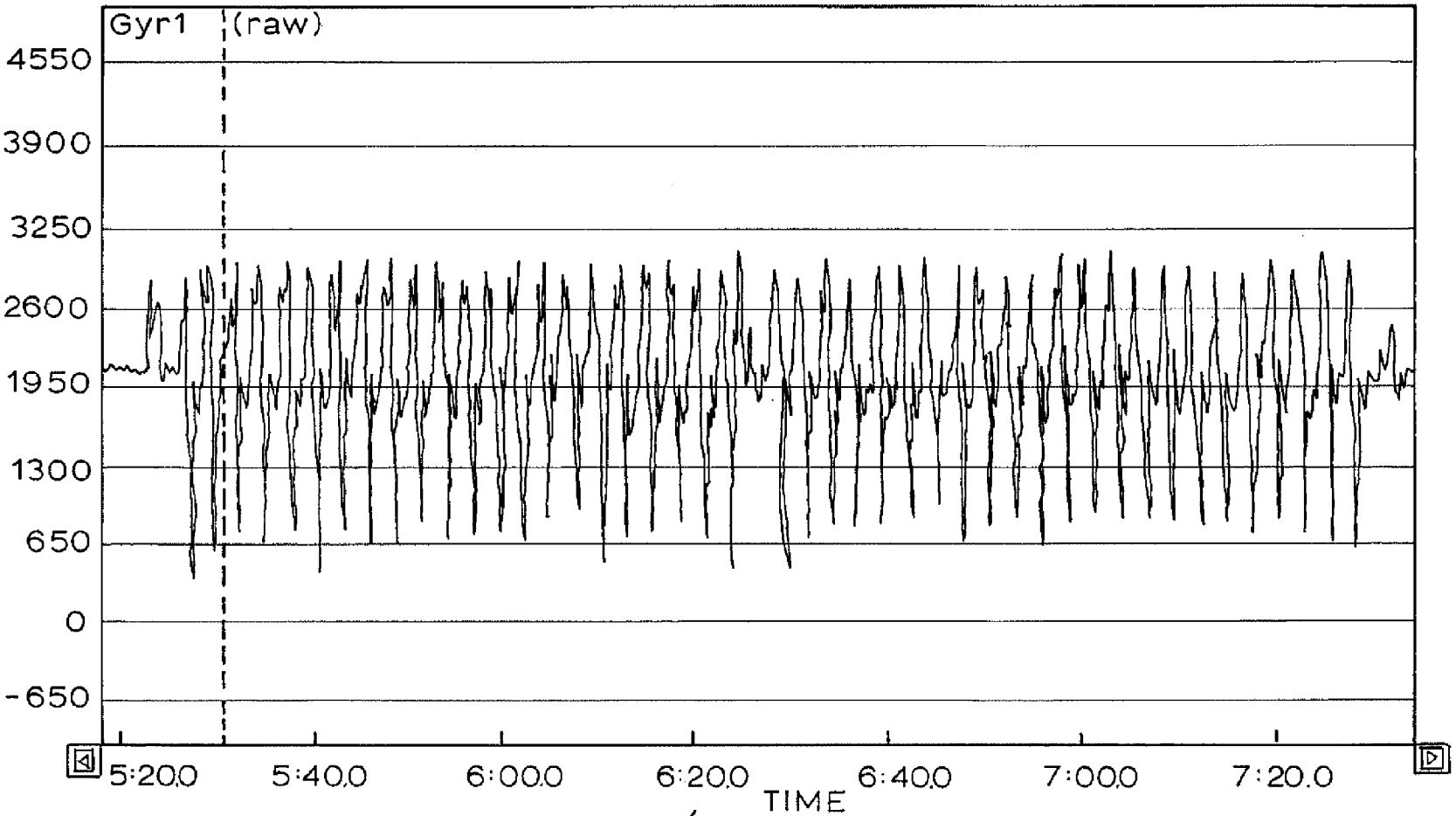
Figure 5:
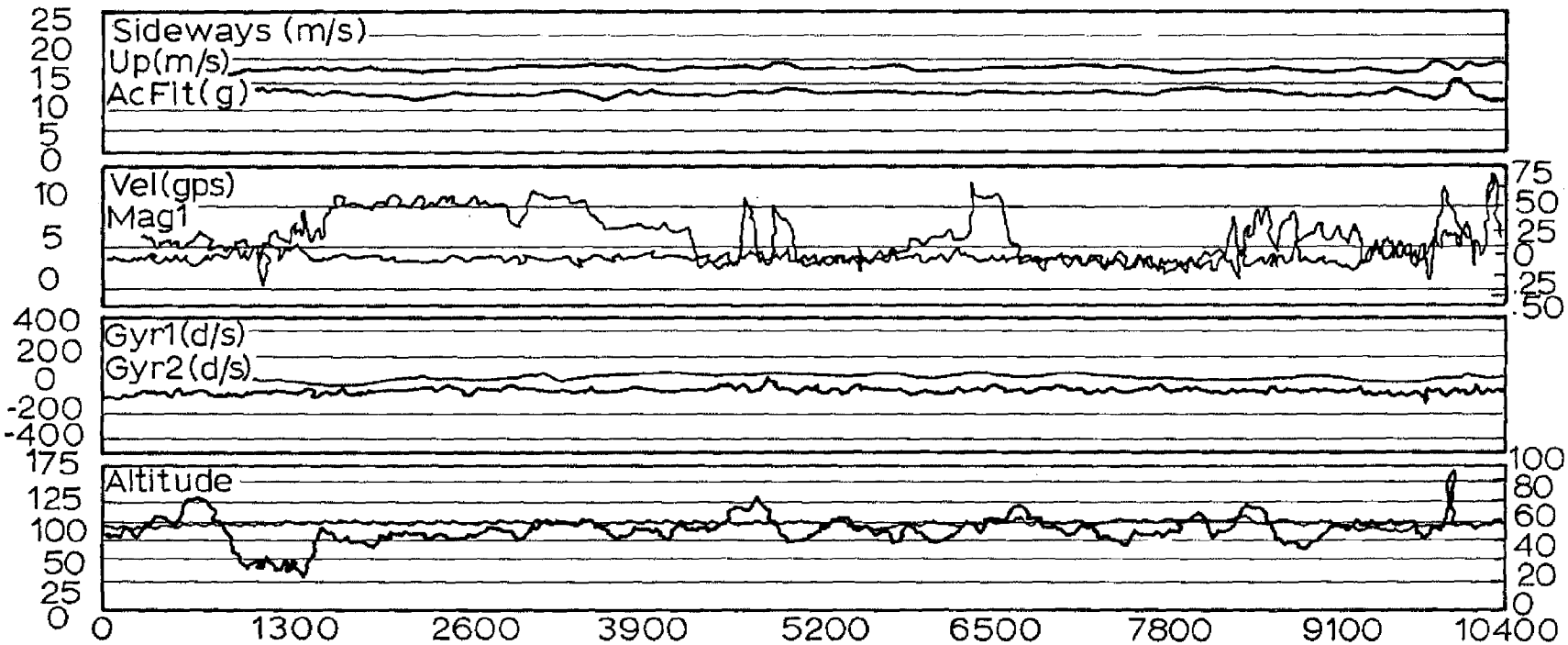
Figure 5:
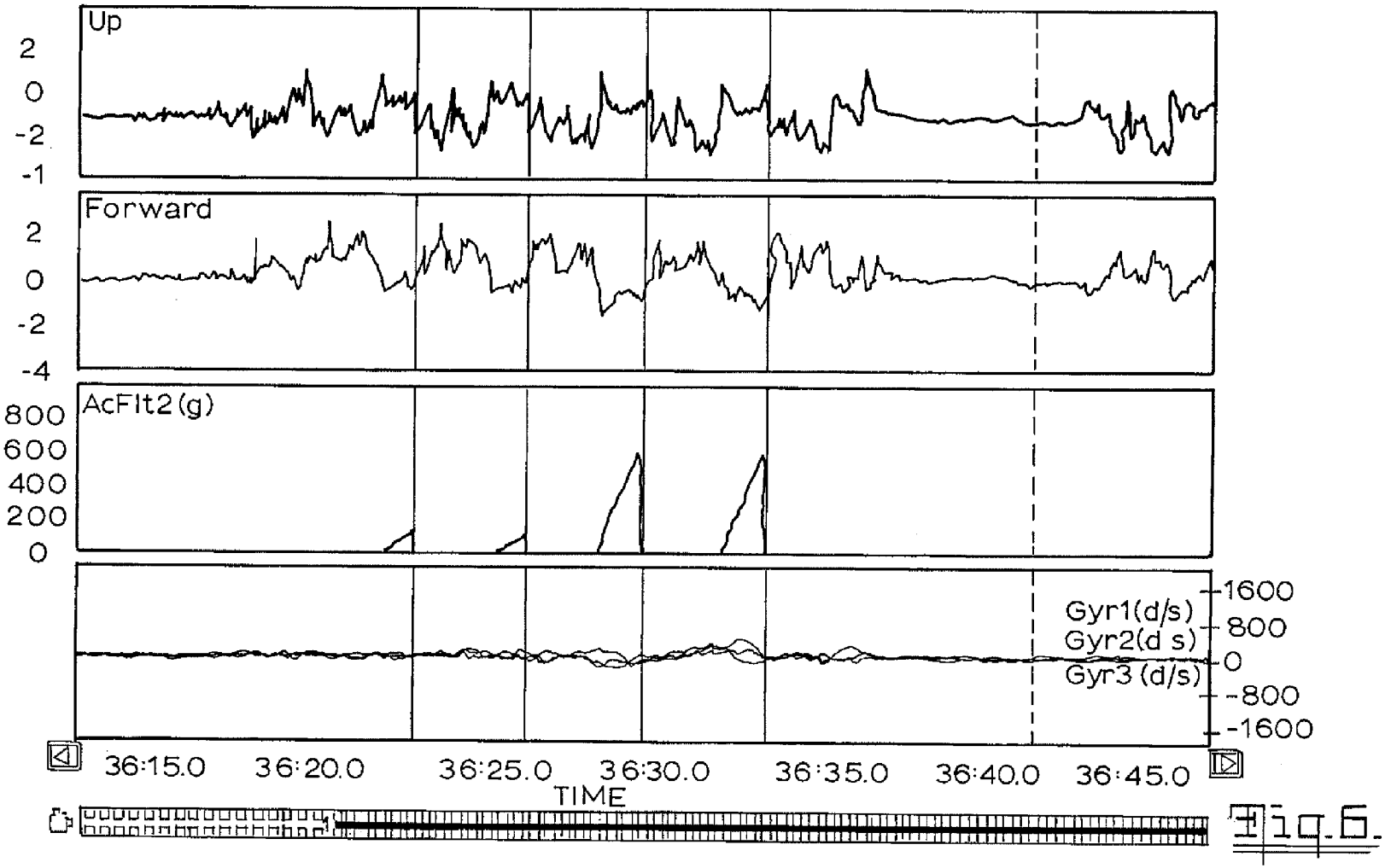
Figure 7:
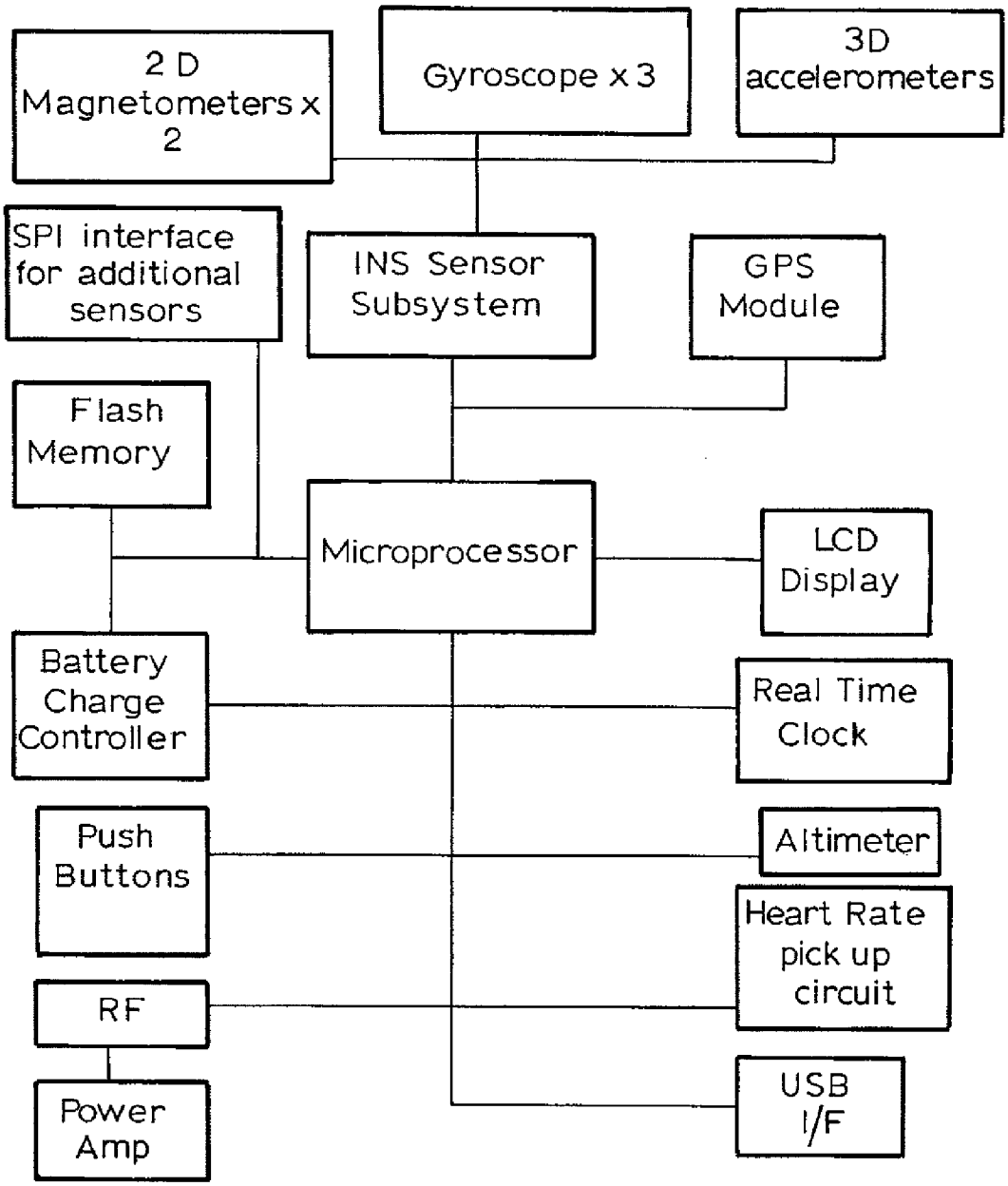

FIG. 4 displays the signal from a gyro sensor mounted on a swimmer;

FIG. 5 displays the readings of a number of sensors for a long distance run;

FIG. 6 are triaxial accelerometer and gyro readings from the device of this invention mounted on a bicycle;

FIG. 7 is a block diagram for second embodiment of the invention.

The device of this invention is a modification of the device described in Australian patent applications 2003277952 and 2006222732.

Recent developments in micro-electromechanical systems (MEMS) technology have opened new avenues for the use of high precision lightweight accelerometers and gyroscopes for new and challenging sports applications (eg. characterise rate and length of rowing stroke and stride). MEMS integrate both electrical and mechanical components on a single chip through extensive research into integrated circuit processing technologies. As MEMS accelerometers originated from monitoring vehicle safety and electronic stabilisation, they only provided very low accuracy measurements. However, as micromechanical devices are inherently smaller, lighter, and usually more precise than their macroscopic counterparts, more and more reliable sensors are becoming available. Accelerometers measure linear acceleration and gyroscopes measure angular acceleration (pitch, yaw and roll).

In this invention accelerometers are used concurrently with gyroscopes to form an inertial or dead reckoning system. The deviation from a known starting point is determined by integration of acceleration in each axis over time. To minimize error the gyroscopes may be used to determine the orientation of the accelerometer and the integrator may be reset to known reference position upon each ground contact. Both gyroscopic and accelerometric transducers are combined to gather and transmit complete 3 dimensional information about an athletes motion.

Inertial sensors errors include inertial system heading errors, gyro scale factor errors, accelerometer scale factor and bias errors and gyro bias errors. These drifts and biases inherent in the inertial sensors will cause a misalignment of the platform and errors in the sensed accelerations, which subsequently results in errors in computed velocities and positions.

The advent of the advanced global navigation satellite systems (GNSS), GPS in particular, has revolutionized conventional precise positioning techniques. GPS has been made more amenable to a wide range of applications through the evolution of rapid static and kinematic methods, and now even more so with the advent of the On-The-Fly (OTF) technique and most recently network-based RTK techniques such as the Trimble virtual reference station system and Geo++ surface correction parameter method. Real-time Kinematic (RTK) or single epoch positioning allows for the determination of the integer ambiguities in real-time.

The display device is a notebook computer or PDA programmed to present the data in a form that is useful to a coach or player.

It is preferred that the device have data logging and IrDA transfer capabilities which makes data storage on the unit of slightly less importance. However storing data on the unit makes sense as the raw data can be streamed into the device and the greater processing power of the unit chip allows for flexible software and display development.

The microprocessor is a Hitachi HD64F3672FP which stems from the H8/300H family. Its main features are:

eight 32-bit registers OR sixteen 16-bit or sixteen 8-bit

Serial communication Interface (SCI)

10-bit ADC (4 channels)

2 k bytes of RAM

The accelerometer unit is powered from a 9 Volt battery, which is regulated down to 5 volts internally. The dimensions of the accelerometer unit are 25 mm×30 mm×9 mm (smaller that the average matchbox). The cover needs to be water proof but importantly the on/off buttons and start/stop buttons etc must be able to be accessed even when the athletes are wearing gloves.

All the chips that have been selected are amongst the smallest available in their range, the Hitachi HD64F3672FP measures on 12 mm×12 mm, this incorporates a 64 pin architecture and the ADXL202 measuring only 5 mm×5 mm.

A GPS unit may be integrated with the data logger system. This could comprise two units, basic unit plus a second unit for GPS. The units would share the same serial line and communicate using a network protocol. Alternatively the GPS unit could be connected to the basic unit and additional firmware code added to receive and retransmit data.

Inertial navigation systems (INS) may be used to cover the information gaps of the GPS outages. When the INS approach is used in rowing, the required sensors need to be small, lightweight, unobtrusive and inexpensive. These requirements can be met when the sensors are manufactured with MEMS technology. However, due to inherent biases and drift errors of accelerometers and gyroscopes, the accuracy of the current state-of-the-art MEMS sensors must be accounted for in high precision tracking. The basic procedure in INS positioning systems is to process the inertial sensor data. The double integration of acceleration measurements, cannot be applied due to the lower accuracy of MEMS sensors. This is because in the double integration, errors accumulate quickly, which soon result in velocity errors comparable to typical rowing speeds. However, the advantages of the INS system include its low cost and high output rate of the movement information.

The high precision GPS system can provide high precision velocity and acceleration information (acceleration is the first derivative of velocity and second derivative of displacement). However the GPS system is normally bulky, expensive and provides a low output rate and high power consumption. To solve these problems, an integrated system takes advantage of both low-cost GPS and MEMS sensors to provide high performance capabilities. MEMS sensors are used to provide precise, high rate (say 200 Hz), low cost, low volume, low power, rugged, and reliable geo-positioning while low-cost GPS may be used for high frequency system calibration (say 5-20 Hz) a lower frequency (1 Hz) is preferred for calibrating the inertial sensors to conserve battery power. It combines measurements from a GPS OEM board and subsequently GPS chip with inertial measurement units from a combination of three MEMS gyroscopes and accelerometers (say Analog Devices).

No minimum frequency is necessary but a 1 Hz GPS receiver is practical and ideally a 2-5 Hz system is preferred. With a 1 Hz receiver accurate velocity and distance measurements can be obtained but sampling the accelerometer data is needed to obtain stroke rate and intra-stroke characteristics. The accelerometer data could be integrated to get intra-stroke velocity but drift would need to be checked every second using the output from the GPS receiver.

A carrier smoothing procedure may be used to improve the accuracy of the low-cost GPS pseudo range measurements. Carrier phase smoothing is a process that the absolute but noisy pseudo range measurements are combined with the accurate but ambiguous carrier phase measurements to obtain a good solution without the noise inherent in pseudo range tracking through a weighted averaging process. A Kalman filtering system will be designed to integrate the two system measurements.

Relative motion of the athlete may be measured using three dimensional accelerometer at say 100 hHz and position and velocity using GPS at say 10 Hz. The device supplies timing information with the measured signals using an internal crystal corrected clock and a GPS derived 1 Hz pulse. The timing is accurate to 0.1 sec per hour. An internal heart rate monitor pickup receives pulses from a coded polar heart rate monitor/transmitter and stores these with a resolution of 1 beat a minute within a range of 0 to 250 beats/minute updated at 1 Hz. The device is powered by a battery sealed into the unit and is rechargeable via an RS232 port. Recording battery life is 6 hours and 1 month in sleep mode. The single universal port allows recharging, connecting an RF module, connecting an external GPS antenna, connecting the external heart rate receiver and to connect a serial cable to send data to the hand held computer device. The device can be fitted into a flexible package of a size approximately 100 mm×70 mm×50 mm and weighs less than 250 g and is buoyant and water resistant. The package is coloured to reduce heating from incident sunlight.

Figure 1:
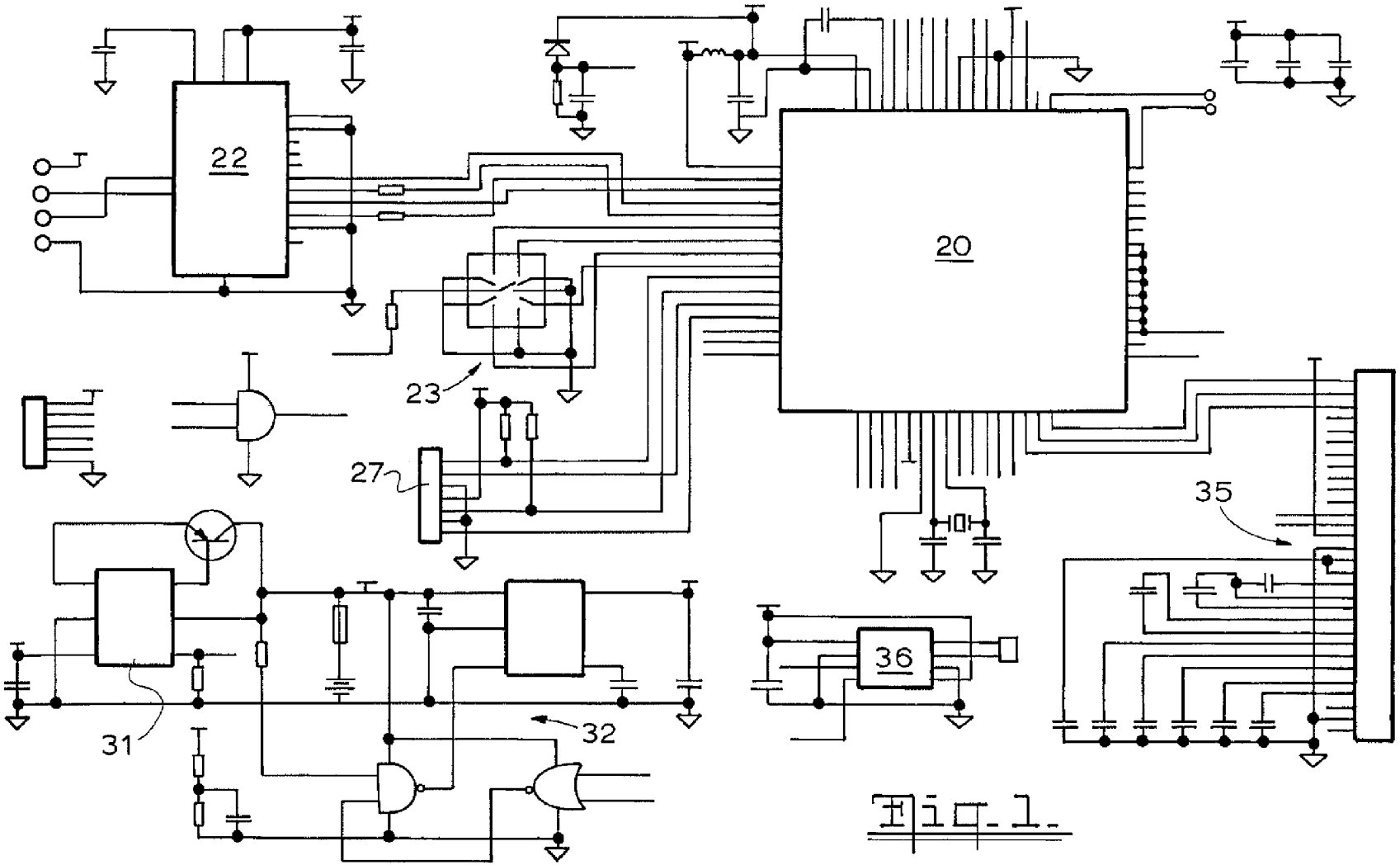
Figure 2:
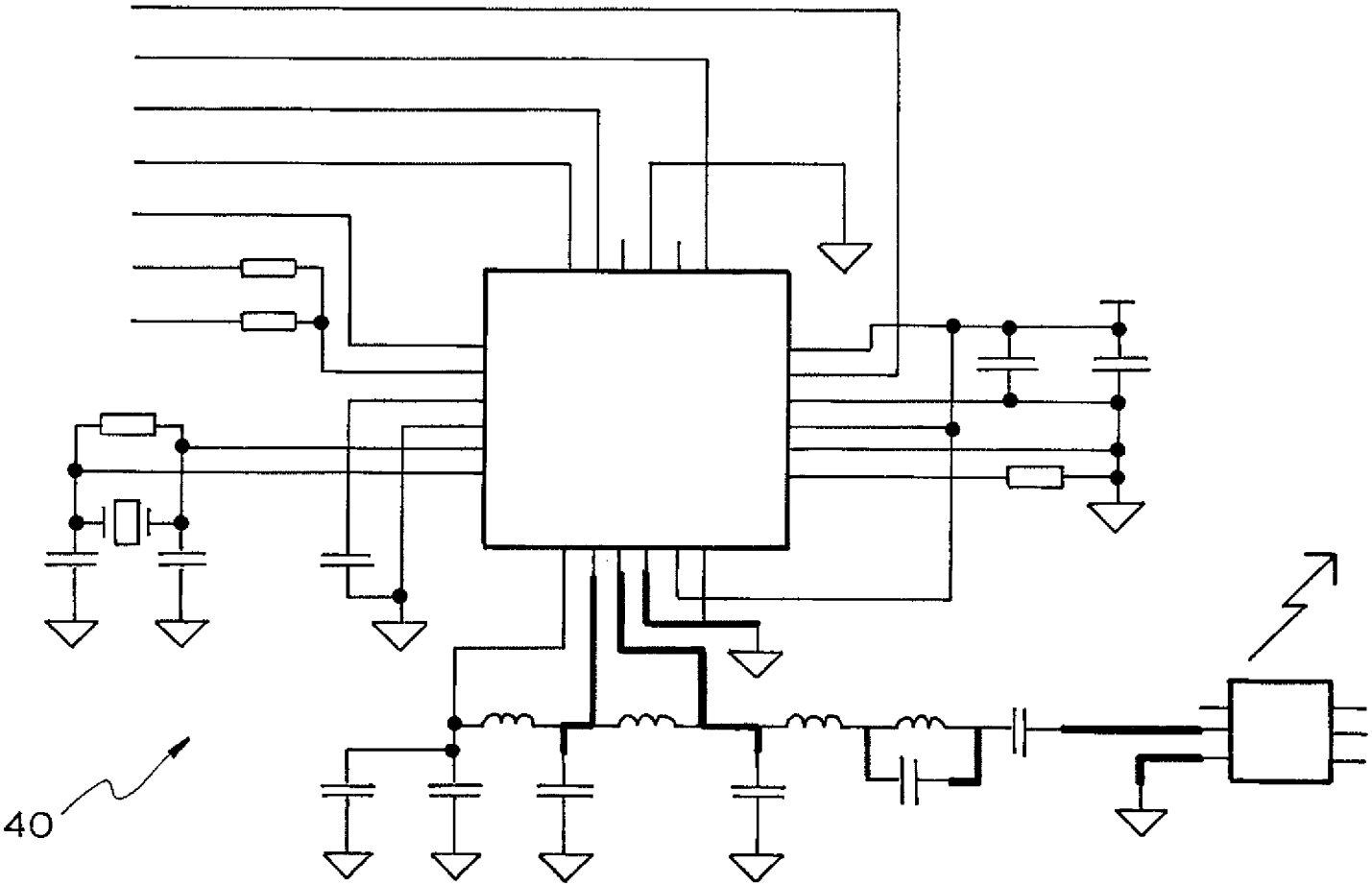
FIG. 2 is the radio transceiver circuit for the monitor of FIG. 1.
Figure 3:
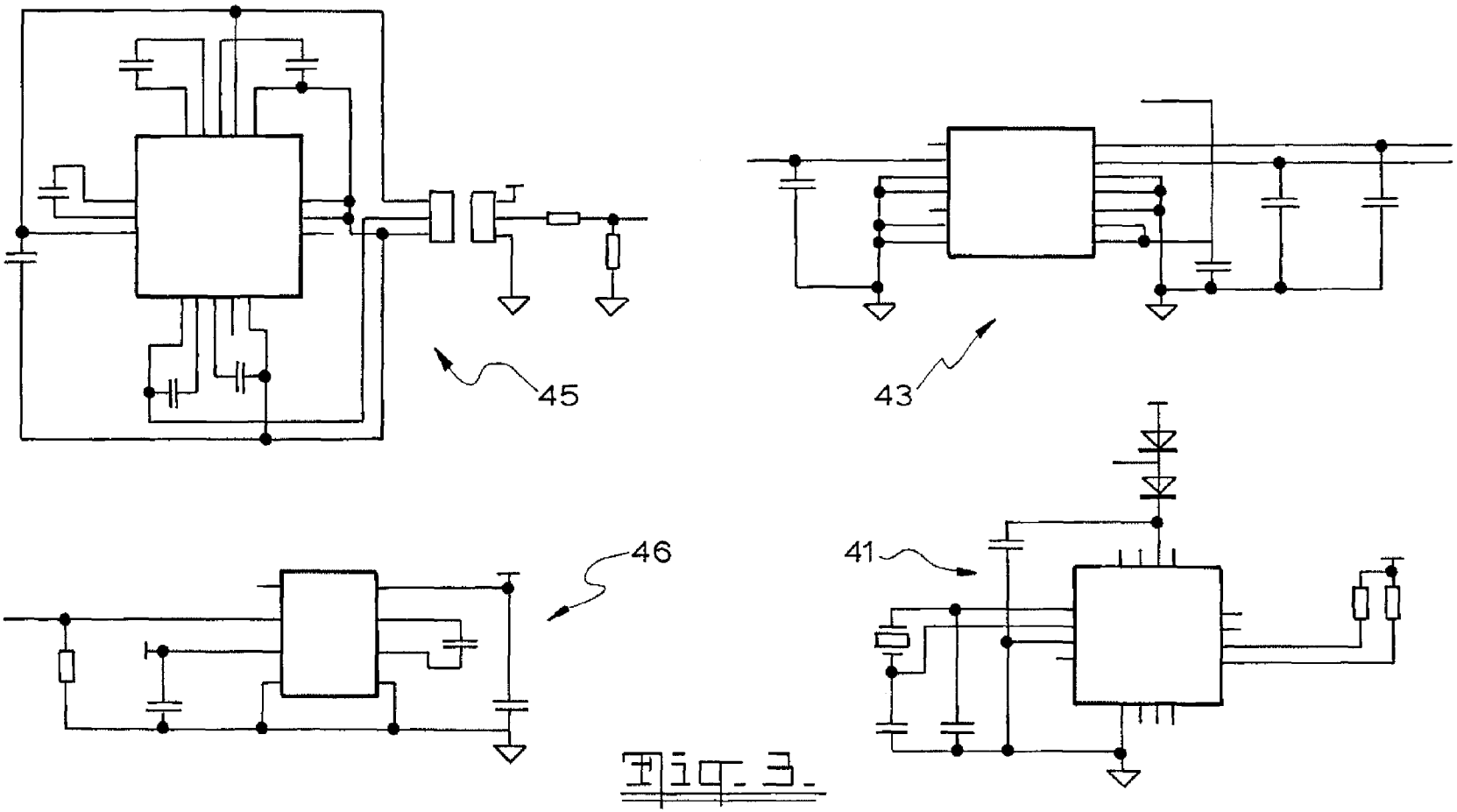
FIG. 3 is the sensor circuits for the monitor of FIG. 1.

FIGS. 1 to 3 illustrate the circuitry used in further embodiment of the invention.

FIG. 1 shows the core circuitry centred on the micro controller 20. The micro controller is preferably an 8 bit Atmel AT mega 128 micro controller. The micro controller can be programmed and can store data and is provided with a 256 megabyte flash memory 27. The USB port 22 is preferably a Silicon Technologies USB to UART data transfer CP 2101 and allows data to be down loaded to a personal computer for further analysis and storage and also allow the battery to be charged by way of the battery charger 31 which in turn is connected to the power supply 32. The microcontroller functions are actuated by the tactile switches 23 which allows the user to navigate through the device menu. The microcontroller displays outputs on the LCD display 35 and also provides a backlight display 36. As shown in FIG. 2 the monitor includes a 2.4 GHz transmitter and receiver 40 so that data can be transmitted and received. The transmitter and receiver 40 see is preferably a GFSK transceiver nRF2401 sold by Nordic Semiconductor. The output power and frequency channels are programmable using a 3 wire serial interface. The GPS unit is an iTRAX 03 by Fastrax with 12 channels and an update rate below 5 Hz with a 1 Hz default rate.

The sensor circuits shown in FIG. 3 are the core components of the real time clock 41 the three axis accelerometer 43 and the gyro sensor 45 which senses angular rate of change and needs its own power supply because it requires a different voltage to the other components. The preferred gyro is ADXRS300 which provides an output signal that is a voltage proportional to the angular rate about the axis normal to the top surface. A single external transistor may be used to lower the scale factor and an external capacitor is used to set the bandwidth.

A display is mounted in a water proof enclosure in a visible location so that the athlete can view summary information such as speed, distance and heart rate. An easily accessible button on the display unit starts the data recording. As soon as the device is switched on recording begins. The coach may take the device after the event and load the data into a personal computer to view the data graphically or combine it synchronously with video footage.

The device can be used to detect strokes and turns in swimming. Analysis of the accelerometer and gyro signals allows a coach to analyse the efficiency of strokes and turns. FIG. 4 illustrates the gyro signals from a device mounted on a swimmer.

For athletics or skiing the device may be attached to an athlete near the small of the back but may also be attached to the ankle adjacent the achilles tendon or to the shoe or ski. An internal antenna may be used or alternatively an extension GPS aerial may be run from the device to the shoulders or other convenient point. A similar location is also suitable for swimming although mounting on the wrist or head is also possible. For cycling, skiing and snowboarding the device may also be attached to the bike ski or snowboard.

In cycling the device may be worn by the rider or mounted on the handlebars of the bike for easy visibility. The pedal cadence can be deduced from the accelerometer data but may be collected from a cadence sensor either wired to the monitor or sent by a wireless blue tooth arrangement.

The RF module enables the real time data to be transmitted to the Coach's wireless enabled PC via a blue tooth connection. Alternatively the data may simply be uploaded after the event.

The device can be adapted for a wide range of sports. Analysis of the signals from the 3 axes of the accelerometer allows coaches to derive information as detailed stride length and variations in the push from each leg of a runner. For long distance training session the data from a group of sensors can be presented as shown in FIG. 5 in which the first frame shows the 3 axes of the accelerometer; the second frame shows the velocity as derived with the assistance of the GPS sensor; the third frame shows the signals from the gyro sensor and the fourth frame contains the altimeter readings over the course.

In skiing can show the power derived from each leg thrust or pole thrust.

In snow boarding loft time and speed can be derived from the data. This uses the accelerometer data to determine the lift off point and the return point to determine the air time. The gyro sensors can be used to analyse and evaluate the complexity of a trick during air time in snow boarding and skiing. The gyro sensors are also useful in swimming and football in analyzing an athletes movements such as a swimming stroke or a kick in foot ball.

One algorithm according to this invention is designed to show air time and total angular movement during the "air". To detect the air it uses three parameters which are available at 100 hz—forward/backward acceleration, up/down acceleration and ac3diff. The first two parameters are filtered through a 2 pass Butterworth filter with a 2.5 hz cutoff. Each ac3diff value is the square root of the sum of the squares of the differences between adjacent triaxial accelerometer readings and is an indicator of activity. This algorithm first looks for the end of an "air" which is indicated by a large spike in ac3dif at landing. The spike must have 5 out of 6 ac3diff readings each at least 0.05 greater than the previous reading. The spike must also rise by at least 0.5 over the 6 readings and must be at least 0.7 secs after the end of the previous "air". The algorithm then looks back for the beginning of the "air" in the 0.3 to 2 seconds range. This is defined as a peak in upward acceleration with a steep approaching slope (10 of 20 points at least 0.03 g above previous point). There must also be a similar steep drop in forward/backward acceleration.

Once the bounds of the air time are established the integrated tria axial gyro data is used to calculate the angle the athlete moves through during the air time. This is a measure of the complexity of the trick.

The readings from a triaxial accelerometer, gyro sensor and GPS mounted on a bike are shown in FIG. 6. Cadence and gear changes can be seen from the forward acceleration and velocity changes. This can be measured using the accelerometers and correcting with GPS. Altimeters can be included for bikes. By computing real forward acceleration the power can be measured. Thus the rider can see on the bike display distance, velocity, cadence and power.

In mountain biking, the device of this invention can separately analyse the various sections of the course and identify uphill, downhill, flat technical and non technical sections. This is also applicable to cross country skiing and running.

In football codes the combination of gyro and accelerometer sensors enables hand balls and kicks to be detected. The algorithm looks for a peak in the pitch gyro (4 gyro readings increasing by 4 degrees per sec followed soon after by 4 decreasing by 3 deg/sec over a period of between 130 and 350 ms. The first reading must be less than −90 deg/sec.

In the further embodiment as illustrated in the block diagram of FIG. 7 the present invention provides a device that incorporates:

3 axis Kionix accelerometers (KXM52-1050) which are low power and low noise in a small footprint 3 gyroscopes from Analogue devices (ADXRS300) aligned orthogonally to measure rotation in 3 directions 2×2D magnetometers from Hitachi (HM55B), which combine to give a 3 dimensional electronic compass A fastrax itrax GPS chip which can be configured to run at up to 5 Hz A nanotron nanolock wireless chip enabling wireless communication at 2.4 GHz with a chirp spread spectrum protocol. Custom written TDMA software enables up to 128 minimaxX devices to broadcast data to a remote coach in real time.

An ARM based micro processor from Atmel (AT91 SAM7X256)

600 mAhr Lithium Ion rechargeable battery 6 layer PCB

A high resolution color LCD

In an impact resistant injection moulded plastic case.

A temperature compensated oscillator for high accuracy timing 256 MB of trans flash memory In team sports, the device is typically worn on the upper back via a custom neoprene padded undergarment.

The addition of the gyroscopes and magnetometers to the package enable a huge number of possibilities in feature extraction for sports.

For instance leading research in strength and conditioning training for soccer is discovering that a large percentage of game play involves running sideways or backwards. Measuring this routinely enables coaches to train athletes for this activity. The combination of magnetometers and GPS provides the orientation of the unit and the heading of the player, enabling users to resolve the direction of movement, and then break this activity into velocity bands in different directions. Specific training activity can target fitness in these areas.

Determining Whether an Athletes Movement is Forward Sideways or Backwards:

Facing Algorithm

The facing calculations take advantage of the onboard accelerometers, magnetometers, and gyroscopes in the device.

The first step in the calculation is to determine the orientation of "up". The three orthogonal accelerometer sensors can measure instantaneous accelerations in space. This instantaneous acceleration can be expressed as a 3 dimensional vector. Although this instantaneous acceleration vector (Ai) is highly sensitive to movement, over a sufficient averaging period, a consistent "up" vector (Aavg) will emerge. Given that calculation of Aavg takes time, this system is insensitive to sudden changes in orientation. The orthogonal gyroscopes alleviate this problem. If we rotate Aavg by the pitch, roll, and yaw angles measured by the gyroscopes, the Aavg vector will remain responsive and valid.

The gyroscopes may suffer from drift problems, but the magnitude of the drift is easily compensated for by the accelerometers.

In other words, the gyroscopes are relied upon to adjust for snap turns and changes in orientation, and the accelerometers aggregate an average "up" vector that is insensitive to noise and can correct slow, long-term gyroscope drift that acts upon this average.

The three orthogonal magnetometers also measure an instantaneous magnetic field vector (Mi). By use of averaging and applying gyroscope-measured rotations, we can, in a similar manner to that of the accelerometers, calculate an average magnetc field vector (Mavg)

As the Earth's magnetic field is not tangent to the Earth's surface at all points, we need to extract the (Earth relative) horizontal components of the field.

At this point the device has calculated:

Aavg (average device-relative up vector)

Mavg (average device-relative north vector)

A North-In-Plane vector is calculated by subtracting from Mavg the vector projection of Mavg on Aavg. In other words the horizontal plane is defined as being orthogonal to Aavg (which is Up), and the vector projection of Mavg onto this plane is taken.

The North-In-Plane vector now holds a device-relative indication of north, constrained to the horizon (as given by Aavg, or the "up" vector)

This is used to define a new vector—a fixed, device-relative indication of "forward". This "forward" vector is not calculated, it is constant and defined. This vector is projected onto the horizon plane implied by Aavg, to generate a vector called Forward-In-Plane.

At this point, the device has calculated:

North-In-Plane—a device relative vector indicating the direction of north, constrained to the horizon.

Forward-In-Plane—a device relative vector indicating the direction of forward, constraned to the horizon.

Finally, facing is defined as the angle that must be swept by rotating clockwise (as seen from above) from the North-In-Plane vector to the Forward-In-Plane vector. By understanding the facing direction f the player backward movement, which is an important skill in sports such as soccer and basketball, can be identified and examined.

In another example, quantification of kicking frequency and intensity is important in monitoring training load and preventing injury. Too many long kicks leads to a higher incidence of osteitis pubis. On the other hand, too few kicking drills leads to poor accuracy and performance. The kicking action in soccer, AFL and other sports results in a distinctive pitching of the back, accompanied by a discontinuity in stride rate. The gyroscopes measure the pitch and the accelerometers the stride, enabling this feature to be automatically extracted and analysed. The magnetometers give further information in the direction of the kick. The GPS signal indicates the position on the field when the kick occurs.

A further feature in elite sports which is of particular interest to strength and conditioning coaches and to rehabilitation, is the intensity and frequency of sharp high velocity turns (ie a player is running hard and has a sharp change in direction). In this case the device, according to this embodiment, can measure the velocity via GPS, and the angular acceleration of the turn via the yaw gyroscope. This enables counting and categorization of the effort, so that training regimes can be made to reflect game needs, and rehabilitating players can have there training loads monitored so that this intense activity is controlled to minimize risk of further injury or interruption to recovery. This is particularly relevant to the current practice of small game training (playing football matches on scaled down fields), which is designed to intensify activity, but results in more sharp turns and potentially more associated injuries.

In the case of rugby, the combination of sensors is used to measure the impact force of a tackle (via accelerometers), the direction of impact (via resolving accelerometer forces), the direction a player was running (via magnetometer), the tackle time (defined as the time from initial impact to the time the player gets off the ground) is determined via a combination of magnetomers and accelerometers providing the time the player is not in a vertical orientation.

The example below shows a series of 6 tackles in a rugby league game. The data is filtered to eliminate high frequencies, and then each tackle is quantified.

In field hockey, the gyroscopes show particular patterns from the sweeping action of striking the ball, the accelerometers show impact with the ball from the jarring motion translated into the body, and the magnetometers show the direction the player is facing, enabling quanitification of long passes.

In general, the combination of all the sensors provides a large number of channels recording the players movement. For any particular feature of play (a kick, tackle, scrum, throw in, etc.) all channels can be examined for a characteristic pattern. Although many times the pattern in one channel will not be completely unique for the activity. Experience has shown that the particular array of sensors in this embodiment generally shows a unique combination of patterns across all sensors. This opens up the possibility of quantifying and analysis all sorts of sports (or general human) activities for use in training, injury prevention, rehabilitation and security monitoring.

A further benefit of this combination of sensors is the ability to combine the outputs to form an inertial navigation system. GPS typically records position, velocity etc. once per second (although in this embodiment the GPS runs up to 5 times per second). In fast moving sports, this is inadequate for accurately monitoring athlete activity because important events happen in split seconds. Combining the inertial navigation system of the accelerometers with the GPS enables detailed time domain information. For instant velocity at 100 Hz can be derived. The software used in this embodiment allows this data to be synchronized to video footage. Highly detailed biomechanical information can then be analysed with respect to video footage for breaking down technique and performance. The inertial navigation system by itself is not able to provide this information because of the drift and offset in typically real sensors. This leads to accumulation of errors in the data. Furthermore a purely inertial based navigation system does not have an absolute reference point—which can be provided by GPS.

Those skilled in the art will realize that the invention may be implemented in a variety of embodiments depending on the water craft used and the number of personnel in the water craft. A variety of sensors may also be used to gather data applicable to the event and the water craft. It will also be appreciated that the logger unit is small and adaptable enough to be fitted to any athlete or sporting equipment where accelerometer data provides useful performance information for coaches and athletes. These include athletics, swimming, team sports such as various football codes, cycling and skiing.

The invention claimed is:

1. A data acquisition system for use in sporting events which incorporates a. at least one inertial sensor measuring angular acceleration in at least one dimension b. at least one accelerometer to derive acceleration and velocity data in 3 dimensions c. a microcontroller with a clock to measure the angular acceleration and accelerometer data d. a power supply e. optional communication means for transmission of angular acceleration and accelerometer data from the microcontroller to a computer device f. said computer device and/or said micro controller being programmed to use the angular acceleration and accelerometer data to provide accurate output of parameters such as velocity, acceleration, changes of direction and distance traveled.

2. A data acquisition system as claimed in claim 1 which also includes a GPS sensor and velocity is derived from the global position sensor and the accelerometer and angular change data is sampled to obtain movement characteristics of the sport being monitored.

3. A data acquisition system as claimed in claim 2 which also includes a magnetometer which combined with GPS data can provide directional data.

4. A data acquisition system as claimed in claim 1 which also includes a physiological sensor.

5. A data acquisition system as claimed in claim 4 in the physiological sensor is a heart rate monitor.

6. A data acquisition system as claimed in claim 1 for a cyclist which also includes a pedal cadence sensor.

7. A data acquisition system for use in sporting events which incorporates a) at least one accelerometer to derive acceleration and velocity data in 3 dimensions b) at least one magnetometer sensing the direction of magnetic north c) a Global Positioning Sensor (GPS)

d) a microcontroller with a clock to measure the magnetometer, GPS and accelerometer data e) a power supply f) optional communication means for transmission of magnetometer, GPS and accelerometer data from the microcontroller to a computer device g) said computer device and/or said micro controller being programmed to use the magnetometer, GPS and accelerometer data to provide accurate output of parameters such as velocity, acceleration, changes of direction and distance traveled.

8. A data acquisition system as claimed in claim 7 which also includes at least one inertial sensor measuring angular acceleration in at least one dimension.

9. A data acquisition system as claimed in claim 7 which also includes a physiological sensor.

10. A data acquisition system as claimed in claim 9 in the physiological sensor is a heart rate monitor.

* * * * *